US005771985A

United States Patent [19]

Jaworski

[11] Patent Number: 5,771,985

[45] Date of Patent: Jun. 30, 1998

[54] EARTH PENETRATING APPARATUS FOR OBTAINING SEDIMENT SAMPLES, DRIVING INSTRUMENT PROBES, PILINGS, OR SHEET PILINGS

[76] Inventor: Bill L. Jaworski, P.O. Box 290, Burley, Wash. 98322

[21] Appl. No.: 728,285

[22] Filed: Oct. 8, 1996

[51] Int. Cl.[6] ..... E21B 7/24

[52] U.S. Cl. ..... 175/55; 175/56; 173/49

[58] Field of Search ..... 175/22, 55, 56, 175/58, 105; 173/49

[56] References Cited

U.S. PATENT DOCUMENTS

| | | | |
|---|---|---|---|
| 3,768,576 | 10/1973 | Martini | 175/56 X |
| 4,018,290 | 4/1977 | Schmidt | 173/49 |
| 4,058,163 | 11/1977 | Yandell | 166/177 |
| 4,403,665 | 9/1983 | Bodine | 175/55 |
| 4,553,443 | 11/1985 | Rossfelder et al. | 74/22 R |
| 4,603,748 | 8/1986 | Rossfelder et al. | 175/19 |
| 4,667,750 | 5/1987 | Wise et al. | 175/55 |
| 5,027,908 | 7/1991 | Roussy | 173/49 |
| 5,058,688 | 10/1991 | Scott et al. | 175/20 |
| 5,435,399 | 7/1995 | Peterson et al. | 175/20 |
| 5,456,325 | 10/1995 | Pantermuehl et al. | 175/6 |
| 5,562,169 | 10/1996 | Barrow | 175/56 |
| 5,601,152 | 2/1997 | Harrison | 175/246 |

FOREIGN PATENT DOCUMENTS 1191768 4/1965 Germany .

*Primary Examiner*—Frank Tsay
*Attorney, Agent, or Firm*—Frost & Jacobs

[57] ABSTRACT

A motor driven eccentric vibrator with a spring isolated biasing mass for applying force to an earth penetrating device to cause the device to penetrate into the earth. The vibrator is rigidly attached to a housing which is rigidly attached to the earth penetrating element, which may be a sampling/core tube, while the biasing mass is suspended from the housing by a suspension that allows relative motion between the housing and the biasing mass in a vertical direction parallel to the longitudinal axis of the earth penetrating element. The biasing mass serves to apply a down force on the housing while not significantly reducing the amplitude of the vibrational displacement of the housing in a vertical direction. This mass also reduces the vibrational displacement of the housing in a horizontal direction caused by a single eccentric vibrator.

19 Claims, 2 Drawing Sheets

EARTH PENETRATING APPARATUS FOR OBTAINING SEDIMENT SAMPLES, DRIVING INSTRUMENT PROBES, PILINGS, OR SHEET PILINGS

BACKGROUND OF THE INVENTION

1. Field of the Invention

The present invention relates to the method and apparatus for driving core samplers, probes, pilings, or the like into the earth. More particularly, the present invention relates to the driving of samplers, probes, piling, sheet piling or the like into bottom sediments in marine environments.

2. General Background

Useful information about bottom sediments in marine environments can be obtained from core samples of the sediments. After recovery, these samples can be analyzed for pollutants or sediment type, or may be used in a variety of studies. Alternately, an instrumented probe can be driven into the sediments to measure electrical resistivity, density, etc. Additionally, pilings of various types are often driven into the earth to support or protect structures.

The taking of core samples of bottom sediments requires forcing the sampler to penetrate into the sediment. Some of the sediment penetrated enters into a sample tube and is retained when the sampler is extracted from the sea bottom. In general, the maximum penetration of the sampler or probe is limited by a combination of force required to insert the cutting tip of the sampler or the tip of the instrument probe into the sediment, and the force to overcome the friction developed by the sampler or probe in the previously penetrated sediment.

The simplest form of a sampling technique is by a diver manually pushing a hollow sample tube into the sediment. This technique, however, is usually only useful for very shallow penetrations due to the limited force available. Deeper penetrations can be obtained by placing a heavy weight on top of the sampler and using gravity to force the sampler into the sediment. The use of a heavy weight can be effective in obtaining deep penetration in some sediments, especially silts and marine clays. Both of these techniques, however, are limited in penetration capability within sandy material, due to the stress built up at the sample tube's cutting tip and friction developed by the packing of the sandy material both inside and around the sample tube.

To obtain deeper penetrations, especially in sandy material, various dynamic approaches have been implemented to overcome the penetration limitations of the above techniques.

One approach is the use of vibratory mechanisms in marine coring systems. The application of a vibratory force to the sampler and the resulting vibratory displacement causes the partial fluidization of the sediment in direct contact with the sampler. This fluidization reduces the friction between the sediment and the sampler. Also, very high instantaneous forces can be generated at the cutting tip of the sampler by a combination of the vibratory forces and the weight of the sampler apparatus. Typically the vibrations are generated by rotating an unbalanced mass or eccentric with a horizontal axis of rotation, driven by an electric, hydraulic or pneumatic motor. A single spinning eccentric generates a vibration force in the plane of rotation of the eccentric with both horizontal and vertical components. The horizontal displacement generated by the vibratory drive is significantly less effective than the vertical displacement in assisting the movement of the sample tube into the sediment.

Also, the horizontal displacement is undesirable due to the resulting additional mixing of material within the sample tube.

A number of vibratory systems have been developed using a pair of identical eccentrics, which are rotated in opposite directions and phased so that the vertical forces generated by the eccentrics are additive while the horizontal forces cancel each other to minimize the horizontal displacements. Consequently, these multiple eccentric devices effectively generate a vertically polarized vibratory displacement at the cost of additional mechanical complexity. In addition to the vibration displacement of the core tube, a source of down force is required for effective penetration. The typical methods of generating this force is to add a weight to the sample tube or vibrator housing, and let gravity pull the sampler into the sampler into the sediment.

Pantermuehl, U.S. Pat. No. 5,456,325 illustrates a marine coring system with a multiple eccentric vibrator adapted to clamp radially around the core tube. Pantermuehl discusses a rigid vibrating head which weighs several hundred pounds in order to supply a down force and effectively penetrate sediments. In order to generate the required displacement in the core tube, a larger, more powerful vibrator assembly is required to displace not only the mass of the core tube but the heavy, static elements of the rigid vibratory head required to supply the necessary down force.

Rossfelder, U.S. Pat. No. 4,553,443, describes a marine coring system which can be configured with either single or multiple spinning eccentrics. Rossfelder discusses a cable system which applies a down force to the light weight vibrating head to improve penetration. A weighted base assembly is coupled to the driving head by means of a winch cable and springs. The springs serve to decouple the mass of the weighted stand from the vibrating head at the operating frequency of the vibrator. Thus, the effective mass that is vibrated is not significantly increased by the source of the additional down force. The use of the weighted stand and cable/spring tensioning system adds cost, complexity, requires the winch to maintain the tension as the core tube penetrates, and in practice makes deployment more difficult. Also, the cable tensioning system does not attenuate the horizontal displacements of the vibratory head when used with a single eccentric vibrating head. Accordingly, there exists a need for a simple, more efficient and easier-to-use earth penetrating device.

SUMMARY OF THE INVENTION

The present invention has solved the problems cited above, and is an earth penetrating apparatus for obtaining sediment samples, or driving instrument probes, pilings, sheet pilings or the like having; an electrically, hydraulically, or air powered vibrator; a housing: an attachment point for attaching a sample/core tube, a probe, or other earth penetrating device; a down force generating biasing mass; a suspension for decoupling the biasing mass and the housing. In some embodiments the suspension will also maintain the relative position of the biasing mass and vibrator in a fixed relation in one plane; and allow the housing, and attached vibrator and earth penetrating device to move or vibrate relatively independent of the biasing mass in a axis perpendicular to the plane.

The vibrator is rigidly coupled to the housing. The housing also provides an attachment point for the sample/core earth tube or earth penetrating element. The suspension allows the vibratory drive means and sample/core tube or earth penetrating element to vibrate without causing significant vibration of the biasing mass. In essence, the suspension minimizes forces applied to the biasing mass over the range of displacements generated by the vibrator. The suspension is designed such that the forces transmitted to the biasing mass at the operating frequency of the vibrator are small and therefore, the resulting vibratory displacements of the biasing mass are very small. Therefore, the vibratory forces applied to and the resulting displacements of the core tube or earth penetrating element are not significantly reduced by the inertia of the biasing mass. In some embodiments the force of gravity acting on the biasing mass is transmitted through the suspension to the core tube or earth penetrating element to aid in penetrating the earth or sediment. As a result, the amplitude of the vibratory displacements of the core tube are larger for a given vibratory drive means while at the same time applying the required down force to the core tube. The suspension, in some embodiments, also minimizes the horizontal displacement between the vibrator drive means and the biasing mass. Therefore, the horizontal vibratory forces generated by the vibratory drive means are applied to the mass of the biasing mass. Consequently, a vibratory drive means including a single eccentric vibrator may be used since the resulting vibratory displacements of the core tube are strongly polarized in a vertical direction. As a result, the vibratory drive means can be smaller and simpler, while providing superior penetration as compared to existing earth penetration apparatus.

DESCRIPTION OF THE PREFERRED EMBODIMENT

Figure 1:
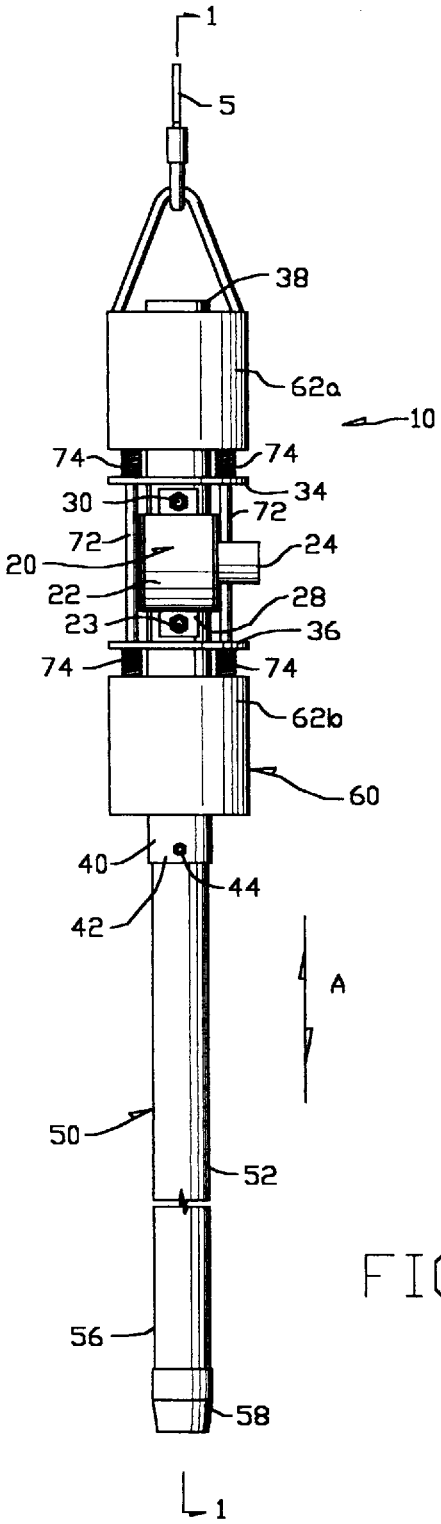
FIG. 1 is a front elevation view of the earth penetrating apparatus constructed in accordance with the present invention.

FIG. 1 illustrates a earth penetrating apparatus 10 in accordance with the present invention, being suspended from a lift line 5. The apparatus 10 includes a housing assembly 20, which is rigidly coupled to an earth penetrating device 50, a biasing mass assembly 60 is suspended from the housing assembly 20 with suspension 70.

Figure 2:
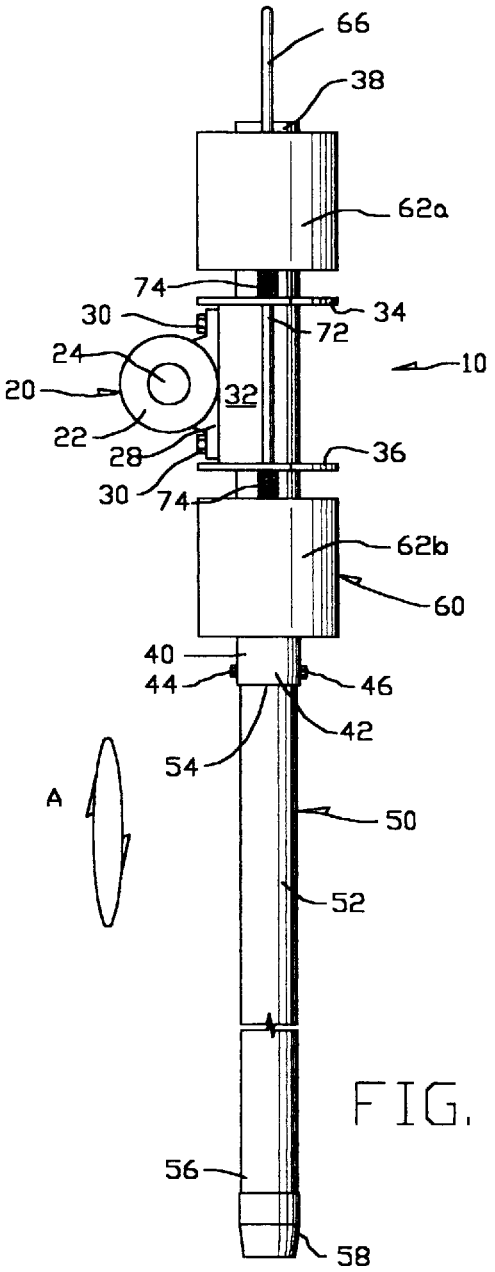
FIG. 2 is a side view of the right side of the earth penetrating apparatus of FIG. 1.
Figure 3:
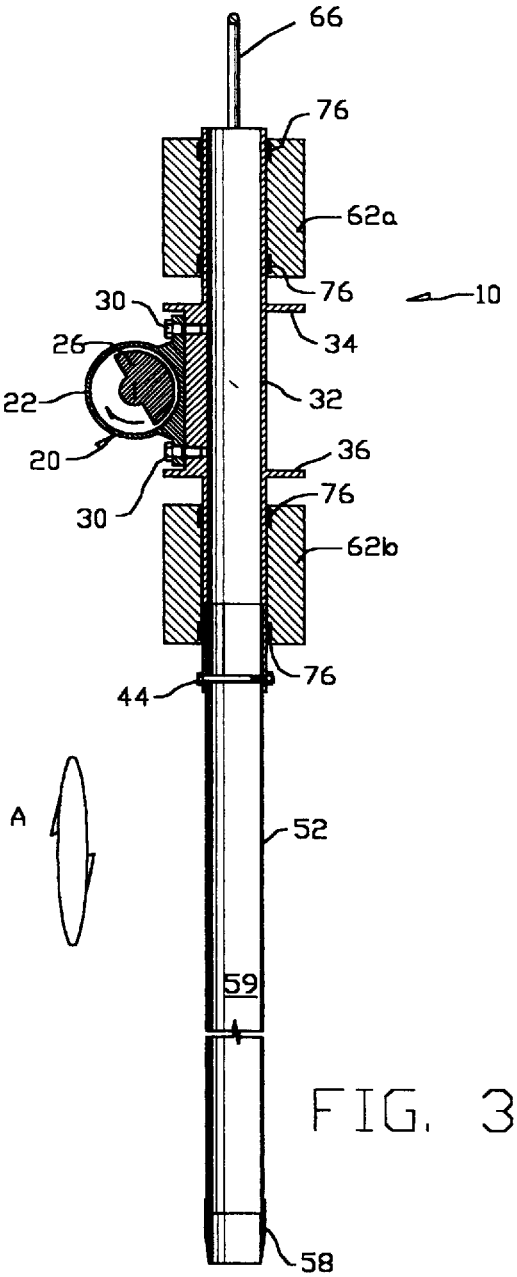
FIG. 3 is a vertical cross-sectional of the earth penetrating apparatus taken along line 1—1 of FIG. 1.

Referring now to FIGS. 2 and 3 showing the earth penetrating apparatus 10 in greater detail. The housing assembly 20 has a single eccentric vibrator 22 which is powered by a drive motor 24. Drive motor 24 is coupled to vibrator 22 so that the drive motor 24 will cause eccentric 26 of vibrator 22 to rotate about an axis perpendicular to the long axis of the earth penetration apparatus. Drive motor 24 and vibrator 22 are common industrial equipment. For marine applications it is preferred but not required to use corrosion resistant materials or coatings on the external surfaces. A base 28 of vibrator 22 is fixed to the light weight axial housing 32 with fasteners 30. Housing 32 has two suspension support flanges, upper flange 34 and lower flange 36. It is preferred that the housing 32 have a hollow shape to minimize the weight of housing 32 which improves the efficiency of the earth penetrating apparatus 10 for a given size vibrator 22. Housing 32 can be made of any material having sufficient mechanical properties that will transmit the vibrations generated by vibrator 22. Additionally, it is preferred for marine application housing 32 to be constructed from or coated with corrosion resistant materials.

Housing 32 typically will have extensions above and below flanges 34, 36, upper extension 38 and lower extension 40. Extensions 38 and 40 slidably engage the biasing mass assembly 60. The surface finish of the extensions 38, 40 should be sufficiently smooth to minimize the friction generated by relative motion between the extensions 38, 40 and the biasing mass assembly 60. The lower extension 40 has an end 42 which receives the earth penetration device 50. FIGS. 1–3 show a core tube assembly as the earth penetrating device. Other earth penetrating devices could include but are not limited to instrument probes, pilings, or sheet piles. The design and construction alternative earth penetrating devices would be obvious to a structural engineer skilled in the art of manufacturing earth penetrating devices. Bolt 44 and nut 46 are used to secure whichever earth penetrating device 50 is selected to the lower end 42 of the lower extension 40 of the housing assembly 20.

Earth penetrating device 50 (core tube assembly shown) has a light weight hollow tube 52 which receives and stores the sample. The hollow tube 52 has an upper end 54 and a lower end 56. The upper end 54 is sized to interconnect with the end 42 of the lower extension 40 of the housing assembly 20. This interconnection provides for the relativity easy removal of the core tube assembly or other earth penetrating device 50, and for the efficient transfer of the vibration forces generated by the housing assembly 20. The lower end 56 interconnects with a removable core cutter 58 made of a hard, corrosion resistant material. The core cutter 58 provides a relatively sharp and durable edge for penetrating the earth. The use of the replaceable core cutter 58 greatly extends the service life of the light weight hollow tube 52. Both the interconnections between the vibrator assembly 20 and the core tube assembly can be made by any number of means. The preferred methods are by interference fit, interference fit with a securing device or by a threaded connection.

The biasing mass assembly 60 provides a constant downward force which operates in conjunction with the cyclic displacements produced by the housing assembly 20 to drive the earth penetrating device 50 into the ground or sediment. Additionally, the biasing mass assembly 60 dampens the horizontal force produced by the housing assembly 20. In essence, the biasing mass assembly 60 working in conjunction with suspension 70 polarizes the vibratory forces produced by the vibrator assembly 20. In order to accomplish this polarization the biasing mass assembly 60 has mass 62, which may be divided into one or more smaller masses for the operators convenience. Mass 62 shown has an upper mass 62*a* and a lower mass 62*b*. Additionally, there is a bail 66 attached to upper mass 62*a*. This bail 66 provides an attachment point for lift line 5 (shown in FIG. 1) which is the typical method of deploying and recovering the earth penetrating apparatus 10.

Suspension 70 has guide rods 72. The upper end of each guide rod is rigidly attached to mass 62*a*, and the lower end of each guide rod rigidly is attached to mass 62*b*. These connections can be threaded, welded, or equivalent connection compatible with the materials collected. The guide rods 72 will pass through openings in both the upper flange 34 and the lower flange 36 of the vibrator assembly. These openings are of sufficient size to allow guide rods 72 to pass through upper and lower flanges 34, 36 with minimal wear and friction. Between the upper and lower flanges 34, 36 and masses 62*a*, are springs 74. Each spring 74 has a guide rod 72 passing there through. In this configuration, the guide rods 72 maintains the springs 74 in the proper location. The assembled length and the spring constant of the springs 74 are such that the downward force generated by the weight of the biasing mass 60 is applied to the housing, while the biasing mass is largely isolated from the vibrational forces generated by the operation of the vibrator 22 at the operation frequency of vibrator 22. The average force applied by the springs 74 between the housing 32 and the biasing mass 60 in a vertical direction balances the force generated by the weight of the biasing mass. The spring suspension is implemented in such a manner as to minimize variations from this average force, due to the vibrational displacements of the housing at the operating frequency of the vibrator. It is well known that other spring assemblies could be used to replace the coil springs 74, such as rubber or polyurethane blocks, compressed air springs or leaf springs. Additionally, if only a single mass is used, the upper mass 62*a* or the lower mass 62*b* would be replaced by one or more flat plates. If more than one plate is used, preferably there would be a plate for each guide rod 72, and each plate would be of sufficient size to retain its associated spring 74 and to serve as an attachment point for bail 66. The biasing mass assembly 60 is coupled to the vibrator assembly 20 with suspension 70. Suspension 70 also has linear bearings 76. These bearings are mounted to mass 62 and allow the housing assembly 20 to move relative to biasing mass assembly 60. This motion is relatively free in the vertical direction and very limited in the horizontal direction. Thus, the biasing mass assembly 60 is attached to the housing assembly 20 with suspension 70. Suspension 70, however, decouples the biasing mass 60 from the housing assembly 20, allowing the housing assembly 20 to vibrate without causing a significant vibration of biasing mass assembly 60.

b. Operation

In operation, the earth penetrating apparatus 10 is deployed from a lifting device and lowered toward the sediment to be cored. The drive motor 24 is energized which causes the vibrator eccentric 26 to rapidly rotate on a horizontal axis. The spinning of the unbalanced eccentric generates a vibratory force which acts through the vibrator base 28 on housing 32. The vibratory force acting on the housing generates a vibratory displacement in the rigidly attached earth penetrating device 50. With the vibrator 22 operating, the earth penetrating apparatus is further lowered and the core cutter 58 and core tube 52 penetrate into the sediment under the weight of the earth penetrating apparatus 10. As the core cutter 58 and then the sample tube 52 penetrates into the sediment, the sediment in contact with the core tube 52 and cutter 58 is partially liquefied by the earth penetrating device 50 of the earth penetrating apparatus 10, thereby reducing the friction between the sediment and the tube 52 and cutter 58. Also, as the earth penetrating device 50 (core tube assembly) penetrates into the sediment, some of the penetrated sediment enters into the core tube bore 59. When the desired penetration of the core tube assembly 50 into the sediment is attained, the apparatus is raised by the lifting apparatus and the drive motor 24 deenergized. The earth penetrating device 50 (core tube assembly) is removed from the earth penetrating apparatus 10 and the cored sediment retained in the bore of the core tube assembly 50 is recovered for analysis. The amplitude of the vibratory displacement of the core tube in a vertical direction is the result of the vibratory force generated by the vibratory drive means acting on the relatively small mass of the housing and the core tube. The vertical vibratory force applied to the biasing mass must be transmitted through the compression springs 74. The force transmitted by a spring is limited by the compression of the spring and its associated spring constant. The compression springs used are such that the forces transmitted by the springs due to the vibratory displacement of the housing are small relative to forces required to accelerate the biasing mass. The natural frequency of the system made up of the compressed compression springs and the mass of the biasing mass is designed to be considerably lower in a vertical direction than the rotational frequency of the vibrator 22.

The amplitude of the vibratory displacement of the core tube 52 in a horizontal direction is the result of the vibratory force generated by the vibrator 22 acting on the combined mass of the housing 32, the core tube 52, and the relatively heavy biasing mass 62. The horizontal vibratory forces applied to the biasing mass is transmitted from the housing through the bearings 76.

The resulting vertically polarized displacement of the earth penetrating apparatus 10 is illustrated by ellipse A shown in FIG. 1 normal to the plane of rotation of the vibrator eccentric, and in FIG. 2 in the plane of rotation of the vibrator eccentric. The ratio of the major and minor axes of the ellipse shown in FIG. 2 is a function of the ratio of the total mass of the earth penetrating apparatus divided by the total mass of the earth penetrating apparatus minus the mass of the biasing mass. Typically, the ratio of these masses is at least five to one.

Having then described the present invention in its preferred embodiments, it should be understood that modification and adaptations may be resorted to without departing from the spirit thereof. Accordingly, the pursuant invention is not to be limited except as by the appended claims.

What is claimed is:

1. An earth penetrating apparatus for driving a core tube, instrument probe, piling, sheet piling or the like into the earth, which comprises:

a housing;

a vibrator mounted to said housing;

a biasing mass;

a suspension, said biasing mass being suspended from said housing by said suspension; and means for attaching an earth penetrating device to said housing.

2. The earth penetrating apparatus of claim 1 wherein said vibrator generates vibrations along at least a first axis.

3. The earth penetrating apparatus of claim 2, wherein said suspension permits a range of motion between said housing and said biasing mass along said first axis, whereby said suspension decouples said biasing mass from vibrations produced by said vibrator.

4. The earth penetrating apparatus of claim 3 where the weight of said biasing mass is supported by said suspension over said range of motion between said housing and said biasing mass.

5. The earth penetrating apparatus of claim 3, wherein said suspension limits the motion between said housing and said biasing mass along a second axis, said second axis being perpendicular first axis.

6. The earth penetrating apparatus of claim 1, wherein said suspension system comprises at least one spring, said spring having a first end and a second end, said first end engaging said biasing mass, said second end engaging said housing, said spring minimizes the transmission of vibrations generated by said vibrator to said biasing mass, whereby said suspension decouples said biasing mass from said vibrator.

7. The earth penetrating apparatus of claim 6, wherein the weight of said biasing mass compresses said spring.

8. The earth penetrating apparatus of claim 5, wherein said suspension further comprises at least one bearing, said bearing mounted to said biasing mass and slideably engaging said housing, said bearing limiting the relative motion between said biasing mass an said housing along a second axis, said second axis being perpendicular to said first axis.

9. The earth penetrating apparatus of claim 8, wherein said bearing further limiting the relative motion between said biasing mass and said housing along a third axis, said third axis being perpendicular to both said first axis and said second axis.

10. The earth penetrating apparatus of claim 8, further comprising an earth penetrating device attached to said housing by said attachment means.

11. The earth penetrating apparatus of claim 10, wherein said penetrating device projects along an earth penetrating axis, said earth penetrating axis being parallel to said first axis.

12. The earth penetrating apparatus of claim 10, wherein said earth penetrating device is a core sample tube.

13. The earth penetrating apparatus of claim 10, wherein said vibrator generates vibrations in a plane parallel to said first axis and said second axis.

14. An earth penetrating apparatus for driving a core tube, instrument, probe, piling, sheet piling or the like into the ear which comprises:

a housing;

at least one vibrator mounted to said housing, said at least one vibrator producing vibrations in at least one plane, said plane being defined by an earth penetration axis and a horizontal axis, said earth penetration axis is the desired direction along which earth penetration is to take place, and said horizontal axis is perpendicular to said earth penetration axis;

at least one biasing mass;

a suspension, said biasing mass being suspended from said housing by said suspension, said suspension polarizing said vibrations so that vibratory displacements produced are directed substantially along said earth penetrating axis; and and means for attaching an earth penetration device to said housing, said attachment means is configured so that when attached said earth penetration assembly will project along said earth penetration axis.

15. The earth penetrating apparatus of claim 14, wherein said suspension comprises:

at least one linear bearing positioned between said at least one biasing mass and said housing, said at least one linear bearing permitting a relatively free movement between said housing and said at least one biasing mass along said earth penetration axis, and said at least one linear bearing restricting the relative motion between said at least one biasing mass and said housing; along said horizontal axis; and at least one pair of springs, said at least one pair of spring having a spring constant selected so that the natural frequency of said at least one biasing mass and said suspension is different from said at least one vibrator.

16. The earth penetrating apparatus of claim 15, wherein said at least one vibrator is at least one single eccentric vibrator.

17. The earth penetrating apparatus of claim 15, further comprising an earth penetrating device attached to said housing by said attachment means.

18. The earth penetrating apparatus of claim 17, wherein said earth penetrating assembly is a core sample tube.

19. The earth penetrating apparatus of claim 1 wherein, said vibrator generates vibrations in at least one plane, said plane being defined by an earth penetrating axis and a horizontal axis, said earth penetrating axis is the desired direction along which earth penetration is to take place, and said horizontal axis is perpendicular to said earth penetrating axis.

* * * * *